United States Patent [19]

Doubleday et al.

[11] 4,003,543

[45] Jan. 18, 1977

[54] COLUMN LIFT BRACKET

[75] Inventors: Max Doubleday, Hackensack, N.J.; Douglas M. Demarest, Port Washington, N.Y.

[73] Assignee: Harsco Corporation, Harrisburg, Pa.

[22] Filed: July 14, 1975

[21] Appl. No.: 595,482

[52] U.S. Cl. ..... 249/48; 249/193; 249/194; 249/219 R

[51] Int. Cl.[2] ..... E04G 13/02; E04G 17/00

[58] Field of Search ..... 249/1, 48, 49, 50, 51, 249/189, 190, 191, 192, 193, 194, 196

[56] References Cited

UNITED STATES PATENTS

| | | | |
|---|---|---|---|
| 921,211 | 5/1909 | Fahrney | 249/51 X |
| 1,871,919 | 8/1932 | Schubert | 249/48 |
| 1,947,413 | 2/1934 | Hay | 249/48 X |
| 3,142,883 | 8/1964 | Kart et al. | 249/191 X |
| 3,917,216 | 11/1975 | Plough | 249/194 X |

*Primary Examiner*—J. Howard Flint, Jr.
*Attorney, Agent, or Firm*—Cameron, Kerkam, Sutton, Stowell & Stowell

[57] ABSTRACT

A column mold system has at least two mold walls for forming a column mold section where the walls are held together by corner brackets. The corner brackets are right angle iron members with a pair of integral legs bent at their upper ends for forming a lifting end. Each leg of the corner bracket has slots correspondingg to slots in the other leg. The slots match similar slots on the ends of the mold walls for joining the corner bracket to the mold wall using wedge connectors. The lifting end of the corner brackets are used to stack mold sections one on top of the other and to strip the mold sections from a poured concrete column.

2 Claims, 7 Drawing Figures

Fig. 1
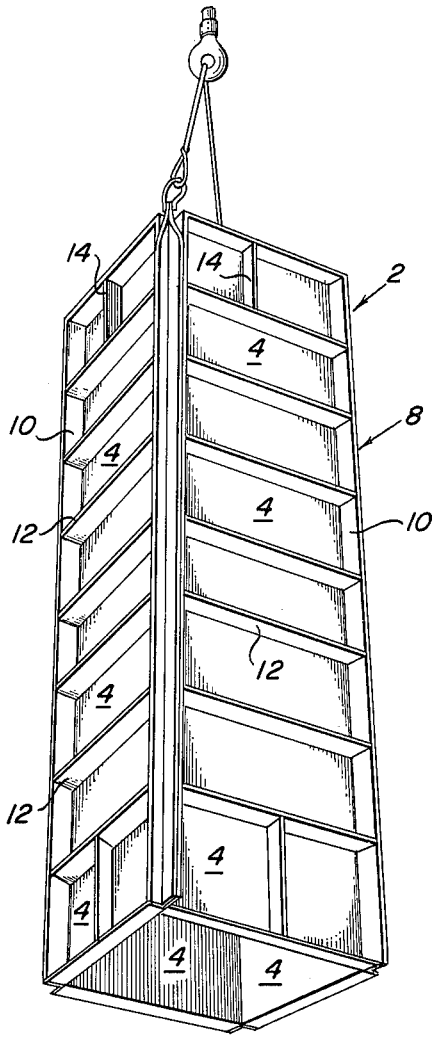
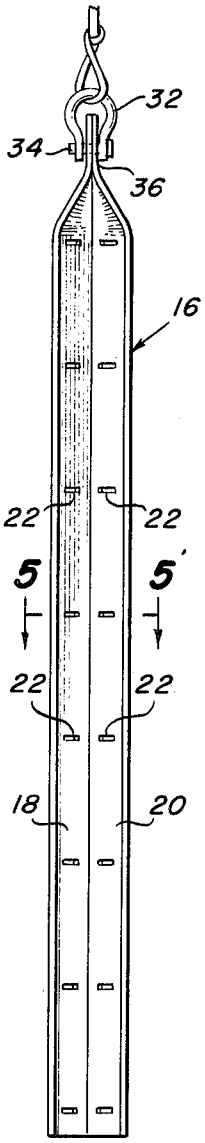
Fig. 4
Fig. 5
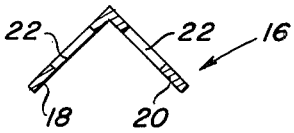
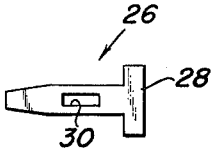
Fig. 6
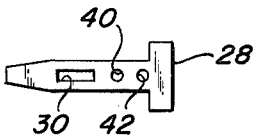
Fig. 7

Fig. 2
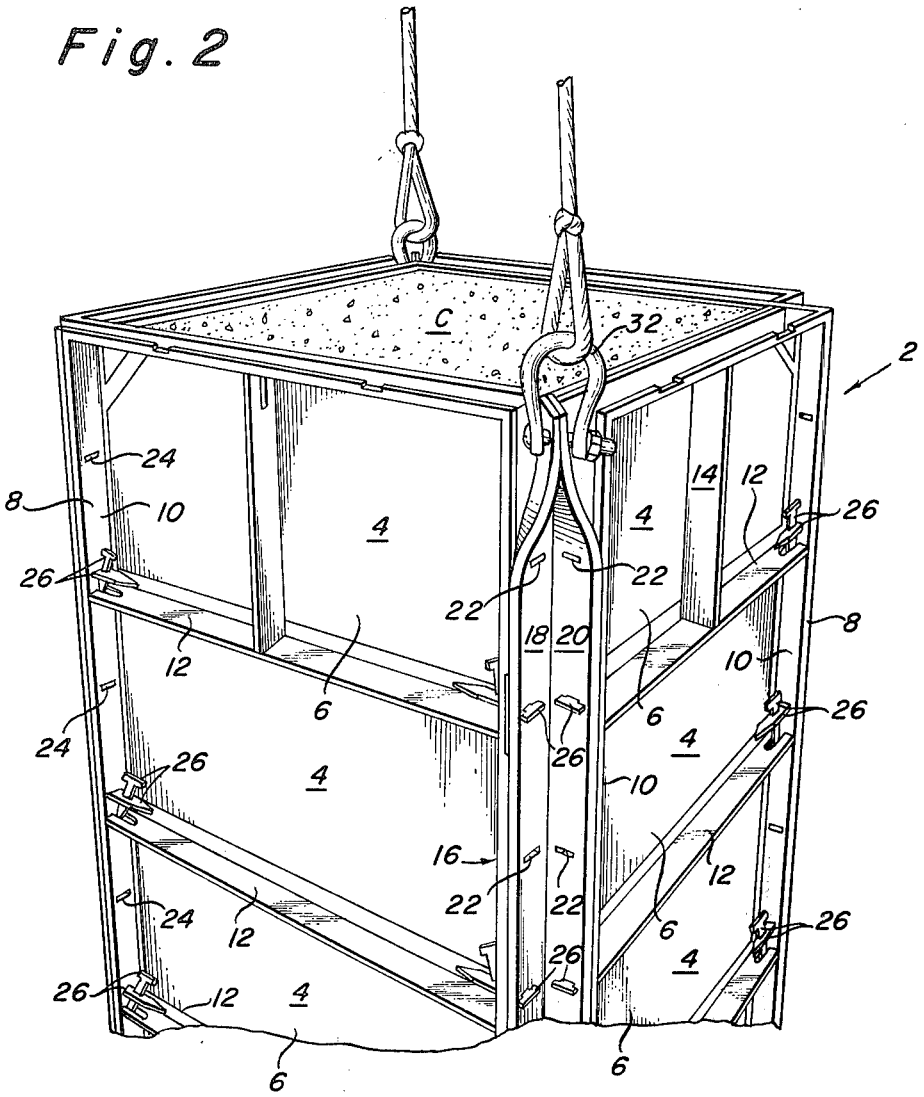
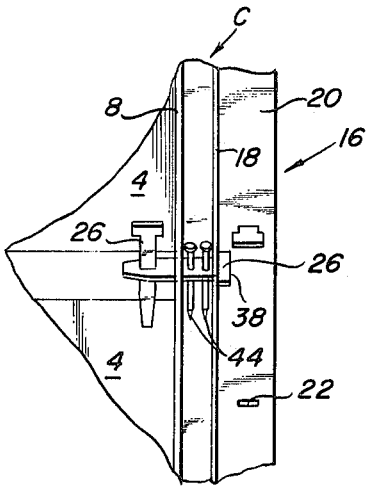
Fig. 3

COLUMN LIFT BRACKET

BACKGROUND OF THE INVENTION

The present invention relates generally to building forms and corner brackets for pouring concrete columns and more particularly to concrete column forms of the panel type wherein the form walls are each constructed of substantially standard rectangular panels assembled to establish a form column against which the wet concrete is poured. In casting concrete columns in place, it is customary to establish spaced form walls connected by corner brackets and to pour the wet concrete into the space provided by the form walls.

Panels commonly employed in this type of concrete column form have a facing of plywood provided with a stiffening and strengthening frame, with the face of the plywood establishing the surface against which the wet concrete is poured. It is further customary to assemble the concrete column form in place using concrete form walls connected by corner brackets and disassembling the form to strip the concrete column once the concrete is set.

SUMMARY OF THE INVENTION

The present invention is directed to an improved corner bracket for assembling column forms and stripping the formed column after the concrete has set. The present invention is particularly directed to a novel corner bracket which can be used with standard wall forms.

It is an object of this invention to provide a corner bracket having lifting means for removing the column form as a unit.

It is a further object of this invention to provide a corner bracket and column assembly form which can be stacked on similar column forms to form a completed column form.

Another object of this invention is to provide a column form and corner bracket construction which is simple to assemble and disassemble.

DESCRIPTION OF THE DRAWINGS

These and other objects of this invention will be readily apparent to those skilled in the art from the following specification and drawings in which:

FIG. 1 is a perspective view of a column form suspended by the column lift bracket according to the present invention;

FIG. 2 is a perspective view of a column form and corner bracket according to the present invention filled with poured concrete with the lifting means in position to remove the column form;

FIG. 3 is a segmental view of a column wall form and corner bracket showing a corner of the form "opened" for hoisting;

FIG. 4 is a view of a column corner bracket of this invention showing both legs of the bracket and the lifting means;

FIG. 5 is a cross-section view taken along the lines 5—5 of the column corner bracket of FIG. 4;

FIG. 6 is a top view of a wedge bolt for joining a column form and corner bracket according to the present invention; and FIG. 7 is a top view of an elongated wedge bolt for use with a column form and corner bracket according to the present invention.

DESCRIPTION OF PREFERRED EMBODIMENT

The column form and corner bracket according to the present invention is best shown in FIG. 2 in which the column form 2 is made up of standard concrete form panels 4 comprising sheets 6 of plywood or similar materials used in making concrete forms, mounted on framing 8. Each frame 8 is made up of vertical frame members 10, horizontal frame members 12 and short cross members 14. The concrete form panels 4 are held together by a corner bracket 16 comprising legs 18 and 20. FIG. 5 shows the corner bracket 16 in cross-section. The bracket is made on angle iron stock with the legs 18 and 20 forming a right angle. It is obvious that a completed column form will have four such corner brackets, one at each corner.

At intervals along the vertical frame members 10 are apertures or holes 24 which are uniformly spaced in all of the vertical frame members which align with similar shaped apertures 22 in the corner brackets 16 of FIG. 4. When a concrete form panel 4 is to be assembled to a corner bracket 16 the apertures 22 and 24 are aligned and wedge bolts or gibs 26, shown in FIG. 6, each of which has an enlarged head 28 and an elongated slot 30, are passed through the apertures. A similar wedge bolt or gib 26 is driven through the slot 30. This action serves to draw the corner bracket and vertical frame member together so that a close joint is formed, sufficiently watertight to prevent ridges from forming in the wet concrete as the column is being cast.

The upper most end of each corner bracket 16 has its legs 18 and 20 closed together at 36, as shown in FIGS. 2 and 4, with a hole, shown as dotted lines 37 in FIG. 2, drilled through the closed legs. A shackle 32 is pivotally connected to upper end of the corner bracket by a bolt 34 which passes through the hole in the closed legs. The column bracket 16 and shackle 32 are used to strip the column form 2 when gang forming columns. The shackle 32 serves as a pick-up point to lift the entire column form as a single unit, or the column may be lifted in two separate pieces by breaking the forms loose on the half-shell.

To strip the column form as a single unit, it is necessary to "open" the form as shown in FIG. 3. The term "open" for the purpose of this specification applies to separating the form panel from the corner bracket enough to free the column form from the poured concrete. To open the form, one vertical line of wedge bolts 26 is removed, and long bolts 38, shown in FIG. 7, are inserted. These long bolts are similar in design to the wedge bolts 26, except that they are longer and have holes 40 and 42. To keep the form open, nails 44 are inserted in holes 40 and 42 of the long bolts 38, thereby preventing the form from closing.

Once the column form has been opened, a hoisting cable 46 is fastened to the opposite corner brackets using shackles 32. The column form will always be hoisted as nearly vertically as possible so not to damage the formed concrete column, this is true even if half a column is stripped at a time. In any case, the angle between the cable from the crane (not shown) and an imaginary horizontal line should never be less than 45°. FIG. 1 shows a column form unit suspended from a crane hook 48 by cable 46 after it has been stripped from a poured column.

The column form units 2 are designed for stacking one on top of another to form an entire column. It is, therefore, necessary that the column bracket be attached to the concrete form panel so the top of the bracket is flush with the top of the form.

While the drawings and description have been so far directed to the forming of square or rectangular columns, it will be readily understood that the column form molds may be curved to form circular columns, in which case column corner brackets would be replaced with column joint forming and lift brackets. Instead of the column lift brackets having right angled legs as in FIG. 5, they would be U-shaped or some other similar shape that would serve as a connection between the column form molds and as a lifting bracket for the assembled column form. There should be at least two such brackets per column form.

While certain preferred embodiments of the invention have been specifically illustrated and described, it will be understood that the invention is not limited thereto as many variations will be apparent to those skilled in the art, and the invention is to be given its broadest interpretation under the terms of the following claims.

What we claim is:

1. A corner bracket for a concrete column mold comprising:

a. an angle iron bar having a pair of legs;

b. each of said legs having a plurality of slots which align with similar slots on the other of said legs;

c. a lifting connection at the upper most end of said angle iron bar for lifting a completed column and d. said lifting connection including said upper most ends of said angle iron bar being in contact in a flattened area to receive a hoist line coupling.

2. A column mold comprising:

a. a plurality of mold sections forming a column mold square in cross-section;

b. corner brackets for connecting adjacent ones of said mold sections together;

c. each of said corner brackets having a pair of integral legs joined at right angle to one another;

d. said legs being bent into contact in a flattened area at their upper most ends forming a lifting means for lifting said completed column mold; and e. connecting means for joining said mold sections to said corner brackets.

* * * * *